US008126188B2

(12) United States Patent
Takase et al.

(10) Patent No.: US 8,126,188 B2
(45) Date of Patent: Feb. 28, 2012

(54) SPEAKER AND METHOD OF PRODUCING THE SAME

(75) Inventors: Tomoyasu Takase, Mie (JP); Mitsutaka Enomoto, Mie (JP); Kazuya Yamasaki, Osaka (JP); Kazutaka Kubo, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 1205 days.

(21) Appl. No.: 11/718,827

(22) PCT Filed: Feb. 20, 2006

(86) PCT No.: PCT/JP2006/002936

§ 371 (c)(1),
(2), (4) Date: May 8, 2007

(87) PCT Pub. No.: WO2006/095561

PCT Pub. Date: Sep. 14, 2006

(65) Prior Publication Data

US 2009/0232345 A1 Sep. 17, 2009

(30) Foreign Application Priority Data

Mar. 10, 2005 (JP) ..... 2005-066968
Mar. 10, 2005 (JP) ..... 2005-066969

(51) Int. Cl.
*H04R 1/00* (2006.01)

(52) U.S. Cl. ..... 381/396

(58) Field of Classification Search ..... 381/396, 381/398, 412; 29/594
See application file for complete search history.

(56) References Cited

U.S. PATENT DOCUMENTS

2004/0086147 A1 * 5/2004 Koura et al. ..... 381/412

FOREIGN PATENT DOCUMENTS

| | | | | |
|---|---|---|---|---|
| JP | 1-309748 | A | | 12/1989 |
| JP | 2000-325879 | A | | 11/2000 |
| JP | 2000325879 | A | * | 11/2000 |
| JP | 2001-238297 | A | | 8/2001 |
| JP | 2002-199490 | A | | 7/2002 |
| JP | 2002199490 | A | * | 7/2002 |
| JP | 2003-37892 | A | | 2/2003 |
| JP | 2004-180193 | A | | 6/2004 |
| JP | 2004180193 | A | * | 6/2004 |

OTHER PUBLICATIONS

International Search Report for PCT/JP2006/302936, dated Jun. 6, 2006.

* cited by examiner

*Primary Examiner* — Curtis Kuntz
*Assistant Examiner* — Sunita Joshi
(74) *Attorney, Agent, or Firm* — RatnerPrestia

(57) ABSTRACT

A plate material is drawn into the shape of a rectangular dish and the peripheral border of each corner is press worked. A yoke is fabricated which has an outwardly projecting tongue-like flange provided at a position a predetermined distance below the top end surface. A frame made of resin is insert molded in a manner covering the flange. A magnet is secured inside the yoke and a magnetic circuit having magnetic gap is formed. A diaphragm joined with a voice coil is joined with the frame. By making a loudspeaker in this way, the bonding strength between the yoke and the frame is enhanced and a low-profile loudspeaker is achieved. Also, clearance at each corner of the yoke is eliminated, and a loudspeaker that is free from magnetic flux leakage and excellent both in quality and performance is obtained.

7 Claims, 5 Drawing Sheets

SPEAKER AND METHOD OF PRODUCING THE SAME

This Application is a U.S. National Phase Application of PCT International Application PCT/JP2006/302936.

TECHNICAL FIELD

The present invention relates to loudspeakers to be used in various audio devices and communications devices, more specifically to small, thin and rectangular loudspeakers for use in mobile phones where loudspeaker mounting space is limited, and to manufacturing method of the loudspeakers.

BACKGROUND ART

Along with the trend toward miniaturization and multi-functioning of various audio devices and communications devices, miniaturization of loudspeakers to be used in these devices is increasingly accelerated. Especially for loudspeakers to be used in mobile phones, not only miniaturization but also high-quality sound is required. Under such circumstances, emphasis of loudspeaker development is placed on rectangular loudspeakers rather than more general circular loudspeakers to enable more efficient use of limited space available in mobile phones where loudspeaker mounting space is limited.

FIG. 6 is a cross-sectional view showing structure of a conventional loudspeaker of this type. FIG. 7 is a perspective view showing structure of a yoke used in the loudspeaker. In FIG. 6 and FIG. 7, by providing four folding portions 11*a* on a previously blanked sheet of a magnetic metallic material and folding them up, yoke 11 is formed into a shape of a bottomed rectangular frame. With this, reduction in material loss and improvement in productivity of yoke 11 can be achieved. Also, by stacking and joining rectangular magnet 12 and rectangular top plate 13 inside yoke 11, a magnetic circuit having rectangular magnetic gap 14 is constructed.

The magnetic circuit and frame 15 in which yoke 11 is press fit are joined with an adhesive. Voice coil 16 is provided in a manner fitting in magnetic gap 14. Central portion of diaphragm 17 couples with voice coil 16 while its peripheral border couples with the peripheral border of frame 15.

In a conventional loudspeaker configured in this way, when an audio signal is input into voice coil 16 fit inside magnetic gap 14, voice coil 16 vertically vibrates due to a magnetic field generated by magnetic gap 14. This further causes vertical vibration of diaphragm 17 to which voice coil 16 is coupled thereby reproducing sound.

As a prior art technical literature related to the invention of this application, Unexamined Japanese Patent Publication 2003-37892, for example, is known.

However, as the above-mentioned conventional loudspeaker is fabricated by a method of preparing yoke 11 that configures a magnetic circuit by bending a sheet of a magnetic metallic material, a clearance is caused at each corner of yoke 11 formed into a rectangular configuration. Accordingly, magnetic flux leakage takes place from the clearances resulting in performance degradation such as reduction in the sound pressure due to reduction in magnetic flux density. There is also a fear of an adverse effect being caused by leakage magnetic flux on other electronic components densely mounted in the vicinity of the loudspeaker.

SUMMARY OF THE INVENTION

The present invention provides loudspeakers excellent in both quality and performance by solving such existing problems by eliminating magnetic flux leakage, and provides manufacturing method of such loudspeakers.

The loudspeaker in accordance with the present invention comprises a magnetic circuit having a magnetic gap, a frame made of a resin material and coupled to the magnetic circuit and, and a diaphragm having a voice coil that can be driven by a magnetic field generated by the magnetic gap and coupled to the center with its peripheral border coupled to the outer circumference of the frame. The magnetic circuit has a yoke formed in the shape of a rectangular dish and a magnet fixed inside the yoke. The magnetic circuit also has a tongue-like flange provided at each corner section that projects outwardly at a position below the top end of the yoke by a predetermined distance. The yoke is insert-molded in the frame in a manner covering the flanges.

Also, the method of manufacturing loudspeakers in accordance with the present invention comprises the steps of: drawing a planar magnetic metallic material into a rectangular dish and subsequently making a yoke having integrally provided tongue-like flanges that outwardly project at a position below the top end of the yoke by a predetermined distance by downwardly press working the peripheral border of the top end of each corner; insert molding the yoke into a resin frame in a manner such that the tongue-like flanges formed on the yoke are covered; making a magnetic circuit in which a magnetic gap is formed by joining a magnet inside the yoke; joining a voice coil to be driven by a magnetic field generated by the magnetic gap to a diaphragm; and joining the diaphragm joined with the voice coil to the frame.

According to the present invention as described above, by providing at each corner a tongue-like flange that outwardly projects at a position below the top end of the yoke by a predetermined distance and insert molding the yoke into a resin frame in a manner covering the tongue-like flanges, it becomes possible not only to greatly enhance the bonding strength between the yoke and frame but also to obtain a low profile. Also, by making the rectangular yoke in the shape of a dish, clearance at each corner is eliminated thus removing magnetic flux leakage and giving the advantage of stably providing loudspeakers which are excellent both in quality and performance.

REFERENCE MARKS IN THE DRAWINGS

1 Yoke
1*a* Flange
2 Frame
2*a* Air vent
3 Magnet
4 Top plate
5 Magnetic gap
6, 10 Diaphragm
6*a*, 10*a* Edge
7, 9 Voice coil
8 Cover

DETAILED DESCRIPTION OF PREFERRED EMBODIMENTS

First Preferred Embodiment

A description of the present invention is given below in terms of the first preferred embodiment.

Figure 1:
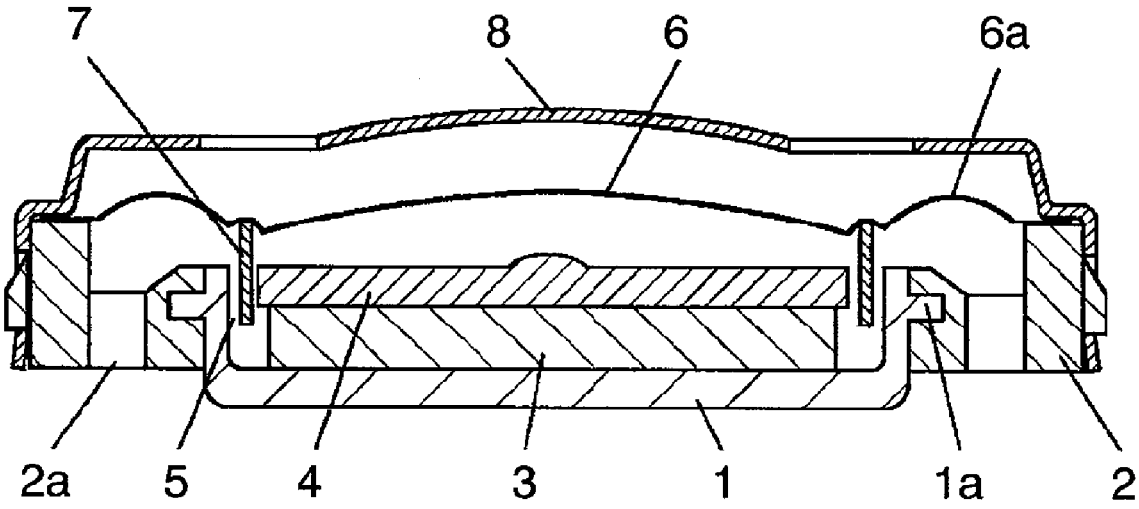
FIG. 1 is a cross-sectional view showing the construction of a loudspeaker obtained by the loudspeaker manufacturing method in the first preferred embodiment of the present invention.
Figure 2:
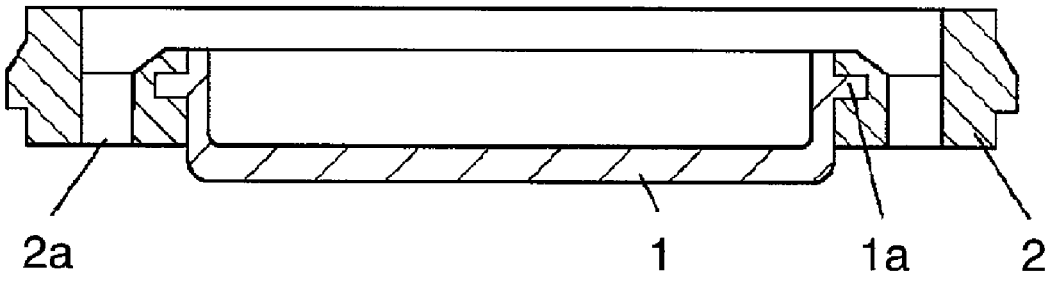
FIG. 2 is a cross-sectional view of a frame having an insert molded yoke to be used in the loudspeaker.
Figure 3A:
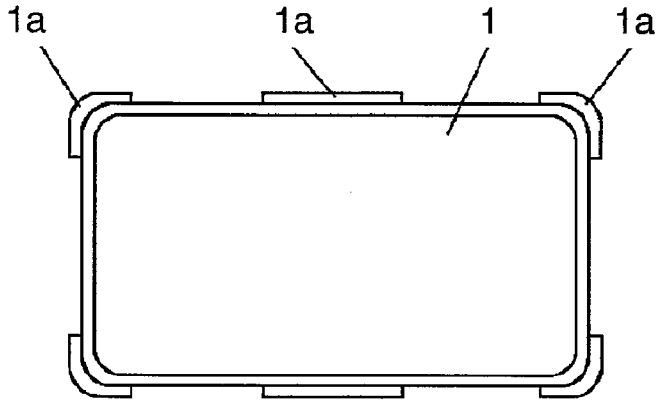
FIG. 3A is a plan view of the yoke used in the loudspeaker.
Figure 3B:
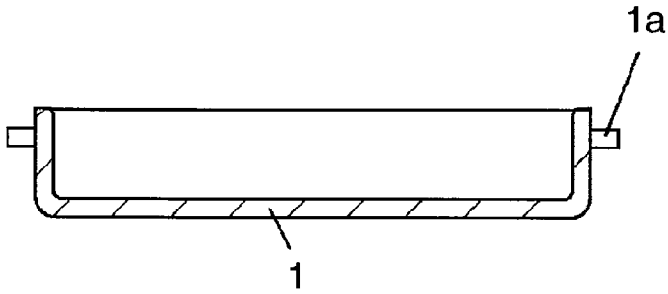
FIG. 3B is a front sectional view of the yoke used in the loudspeaker.
Figure 3C:
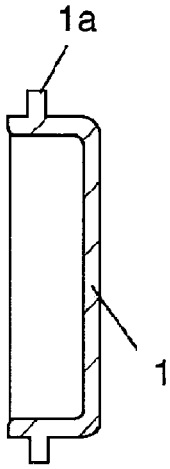
FIG. 3C is a side sectional view of the yoke used in the loudspeaker.

FIG. 1 is a cross-sectional view showing the structure of a loudspeaker obtained by the method of manufacturing loudspeakers in accordance with the first preferred embodiment of the present invention. FIG. 2 is a cross-sectional view showing a frame in which a yoke used in the loudspeaker is insert-molded. FIG. 3A, FIG. 3B, and FIG. 3C are, respectively, plan view, front cross-sectional view, and side cross-sectional view of the yoke used in the loudspeaker. In FIG. 1, FIG. 2, FIG. 3A, FIG. 3B, and FIG. 3C, yoke 1 is formed into the shape of a rectangular dish using a magnetic metallic material. Also, tongue-like flange la that projects outwardly from a position below the top end surface of yoke 1 by a predetermined distance is symmetrically provided at each corner and on the long sides. By providing the flanges at a position lowered by a predetermined distance, yoke 1 can be secured to frame 2.

Air vents 2*a* are provided on resin-made frame 2. When forming frame 2, yoke 1 is inserted molded in a manner covering tongue-like flanges 1*a* provided on yoke 1. Furthermore, the loudspeaker is so structured that the bottom of yoke 1 will project from the bottom surface of frame 2 after insert molding, thus making it easy to print or stamp indication marking of part number or lot number on the bottom of yoke 1.

Magnet 3 fixed inside yoke 1 and top plate 4 joined on top of magnet 3 form a magnetic circuit that has magnetic gap 5.

Voice coil 7 is joined to the central portion of diaphragm 6 that has integrally formed edge 6*a* on the outer circumference. Voice coil 7 is arranged in a manner fitting inside magnetic gap 5 formed in the magnetic circuit. And, by inputting an audio signal to voice coil 7, a magnetic field is generated by magnetic gap 5 thus causing voice coil 7 to vertically vibrate. Diaphragm 6 joined to voice coil 7 is also caused to vertically vibrate thus reproducing the audio signal. Cover 8 protects diaphragm 6.

FIG. 4A to FIG. 4F are diagrams showing manufacturing method of yoke 1. A description of this manufacturing method will be given in the following.

Figure 4A:
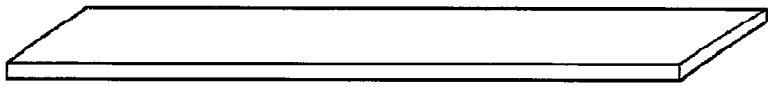
FIG. 4A is a diagram showing the method of manufacturing a yoke to be used in the loudspeaker.
Figure 4B:
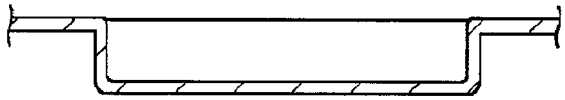
FIG. 4B is a diagram showing the method of manufacturing a yoke to be used in the loudspeaker.

First, as shown in FIG. 4A, a plate of magnetic metallic material is punched to a rectangular shape of predetermined dimensions. Subsequently, the rectangular plate is drawn by press working to the shape of a dish having a concave cross-section as shown in FIG. 4B.

Figure 4C:
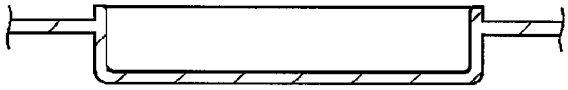
FIG. 4C is a diagram showing the method of manufacturing a yoke to be used in the loudspeaker.
Figure 4D:
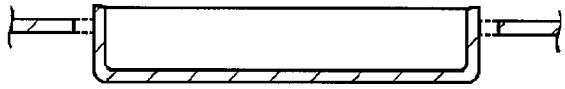
FIG. 4D is a diagram showing the method of manufacturing a yoke to be used in the loudspeaker.

Subsequently, as shown in FIG. 4C, a flange that outwardly projects from a position a predetermined distance below the top end surface is integrally formed by downward press working of the peripheral border of the top end surface of a rectangular dish-like molded body. Then, as shown in FIG. 4D, leaving only those flanges that are formed at corners, other unnecessary parts are removed by punching.

Figure 4E:
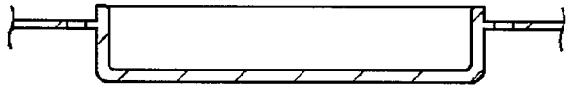
FIG. 4E is a diagram showing the method of manufacturing a yoke to be used in the loudspeaker.
Figure 4F:
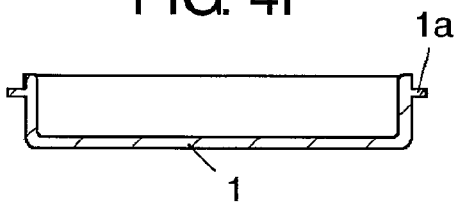
FIG. 4F is a diagram showing the method of manufacturing a yoke to be used in the loudspeaker.

Next, the remaining flanges are pressed again to a predetermined thickness as shown in FIG. 4E. Finally, as shown in FIG. 4F, unnecessary outer portions of the flanges are removed by punching thereby providing yoke 1 on which tongue-like flanges 1*a* are integrally provided.

Here, flanges 1*a* integrally provided on yoke 1 may be extended over the entire outer circumference of yoke 1. However, it is difficult to provide an outwardly projecting flange over the entire circumference by pressing a very small dimension as fracture may occur on the way due to insufficient elongation of the flange material. A structure in which flanges are partially provided at each corner in a symmetrical way or on the long sides like the flanges described in the first preferred embodiment of the present invention is the most effective and productivity is also good.

In a loudspeaker that uses yoke 1 as manufactured in this way in accordance with the first preferred embodiment, tongue-like flange 1*a* that outwardly projects from a position a predetermined distance below the top surface of yoke 1 is provided. And, by insert-molding yoke 1 in frame 2 in a manner covering flange 1*a*, not only the bonding strength between yoke 1 and frame 2 is greatly improved but also a low profile can be obtained. Furthermore, by forming rectangular yoke 1 into the shape of a dish, clearance at each corner can be eliminated thus eliminating magnetic flux leakage and enabling stable manufacture of loudspeakers that are excellent in both quality and performance.

Second Preferred Embodiment

A description of the present invention will be given below referring to the second preferred embodiment.

In the second preferred embodiment, the structure of the voice coil used in the loudspeaker is different from that used in the first preferred embodiment. As other structures are the same as those in the first preferred embodiment, elements similar to those in the first preferred embodiment are given the same reference numbers and detailed description of those elements are omitted, and description will be given only on the different elements referring to drawings.

Figure 5:
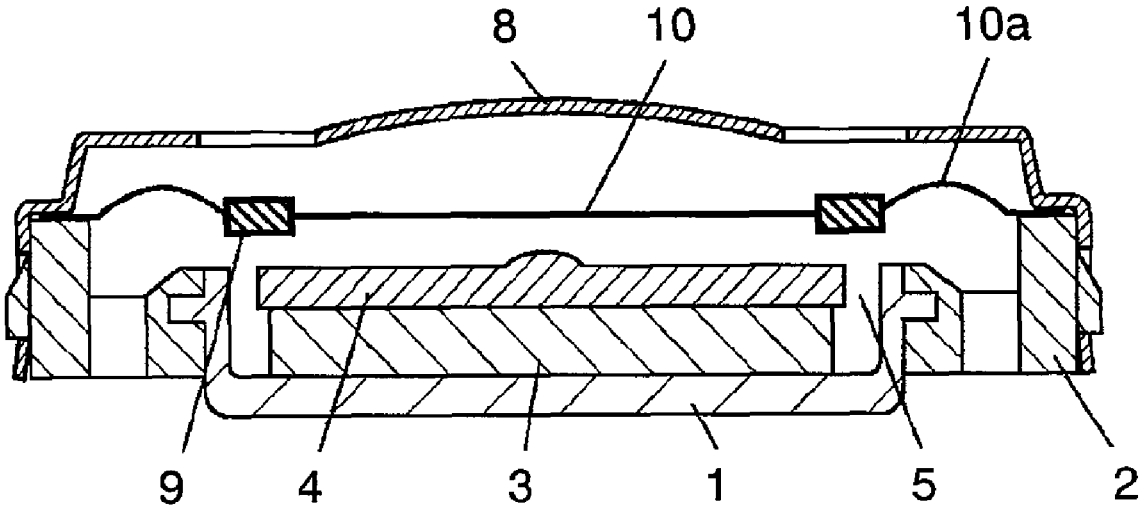
FIG. 5 is a cross-sectional view showing the construction of a loudspeaker obtained by a loudspeaker manufacturing method in the second preferred embodiment of the present invention.
Figure 6:
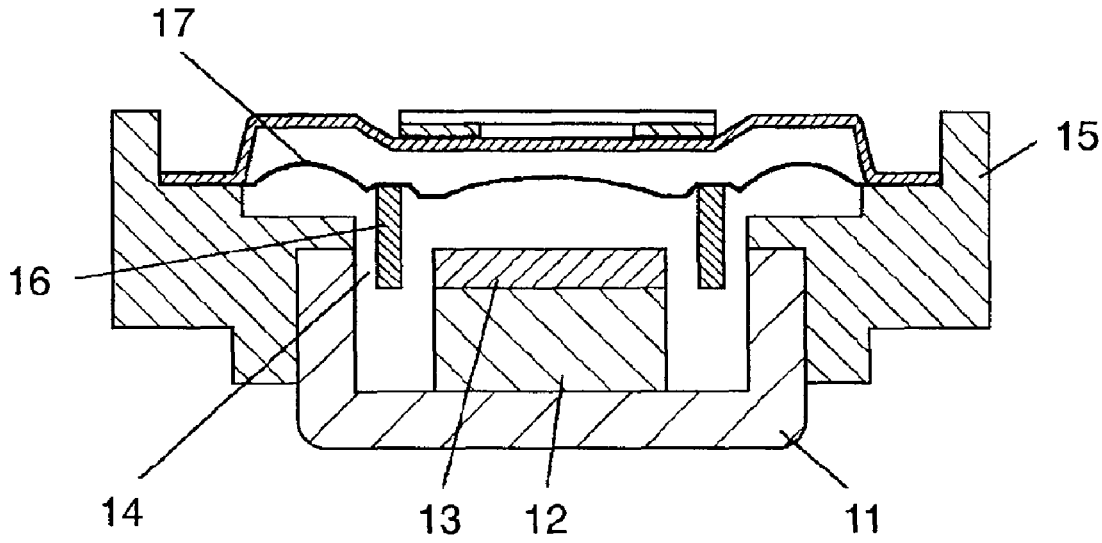
FIG. 6 PRIOR ART
FIG. 6 is a cross-sectional view showing the construction of a conventional loudspeaker.
Figure 7:
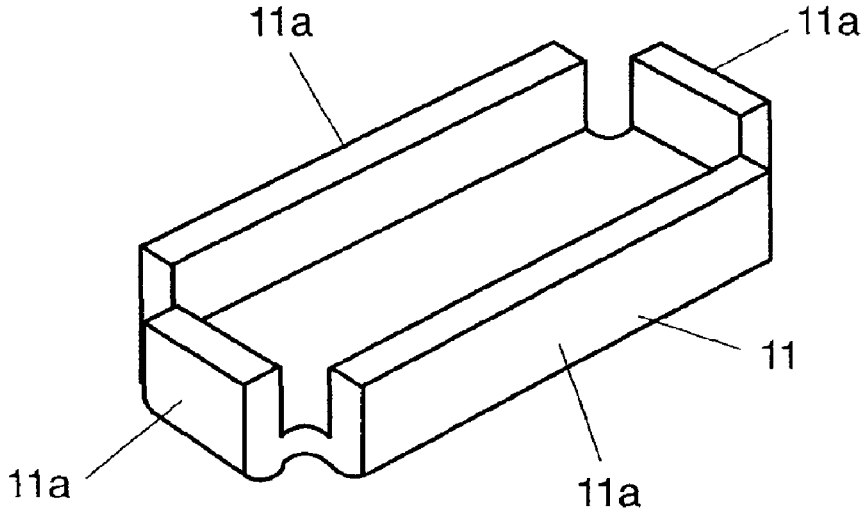
FIG. 7 PRIOR ART
FIG. 7 is a perspective view of a yoke used in the loudspeaker.

FIG. 5 is a cross-sectional view showing the structure of a loudspeaker obtained by the method of manufacturing loudspeakers in the second preferred embodiment of the present invention. In FIG. 5, voice coil 9 is formed by forming a wound coil of a predetermined pattern on the top and rear sides of a resin base material.

The base material of voice coil 9 excluding the coil is joined to the center of diaphragm 10 that has an integrally formed edge 10*a* on the outer circumference in a manner such that voice coil 9 is disposed above magnetic gap 5 and close to magnetic gap 5 without touching. Voice coil 9 is disposed above magnetic gap 5 and opposite to magnetic gap 5.

Base material of the central portion of diaphragm 10 has rigidity while edge 10*a* is made of a flexible material. Accordingly, the degree of freedom of motion of diaphragm 10 is high thus fully assuring the dynamic range of the sound coming out from the loudspeaker.

Similar to the loudspeaker in accordance with the first preferred embodiment, the loudspeaker configured in this way in accordance with the second preferred embodiment is free from magnetic flux leakage and is excellent both in quality and performance. As voice coil 9 can be made lightweight and its shape can be freely changed, it is possible to manufacture a loudspeaker that is adaptable to any shape even when the mounting space is limited.

INDUSTRIAL APPLICABILITY

The loudspeaker in accordance with the present invention is free from magnetic flux leakage and is excellent in both quality and performance. Also, the method of manufacturing loudspeakers in accordance with the present invention is useful for manufacturing loudspeakers for use in information-communication devices such as mobile phones.

The invention claimed is:

1. A loudspeaker comprising:

a magnetic circuit having a magnetic gap, a resin-made frame joined with the magnetic circuit, a diaphragm having a voice coil to be driven by a magnetic field generated by the magnetic gap joined to a central portion of the diaphragm with a peripheral border thereof joined to an outer circumference of the frame, wherein:

the magnetic circuit has a yoke formed into the shape of a rectangular dish, having a continuous wall extending between adjacent sides of the yoke and a magnet joined inside the yoke, the yoke has a tongue-like flange projecting outwardly from a position a predetermined distance below the top surface of the yoke, the flange is provided at a corner of the yoke and is symmetrically provided on the long side of the yoke, and the yoke is insert-molded to the frame in a manner covering the flange.

2. The loudspeaker of claim 1 wherein bottom of the yoke insert-molded in the frame projects from the bottom of the frame.

3. The loudspeaker of claim 1 wherein the voice coil is formed with a wound coil of a predetermined pattern on one side of a resin base board.

4. The loudspeaker of claim 3 wherein the diaphragm is formed of resin and the base material excluding coil portion of the voice coil is joined to the central portion of the diaphragm.

5. The loudspeaker of claim 4 wherein the voice coil is closely disposed above the magnetic gap without contacting with the magnetic gap.

6. A method of manufacturing a loudspeaker comprising steps of:

drawing a flat plate of a magnetic metallic material into a rectangular dish, wherein the rectangular dish has a continuous wall extending between adjacent sides of the yoke;

integrally providing an outwardly projecting tongue-like flange at a position a predetermined distance below the top surface of a yoke by downward press working peripheral border of the top end surface of each corner of the yoke, wherein the flange is provided at a corner of the yoke and is symmetrically provided on the long side of the yoke;

insert-molding the yoke into a resin frame in a manner covering the tongue-like flange formed on the yoke;

making a magnetic circuit having a magnetic gap formed by joining a magnet in the yoke;

joining a voice coil to be driven by a magnetic field generated by the magnetic gap and a diaphragm; and joining the diaphragm joined with the voice coil and the frame.

7. The method of manufacturing a loudspeaker of claim 6 further comprising a step of forming a predetermined pattern of a wound coil on one side of a resin base board.

* * * * *

UNITED STATES PATENT AND TRADEMARK OFFICE

CERTIFICATE OF CORRECTION

PATENT NO. : 8,126,188 B2
APPLICATION NO. : 11/718827
DATED : February 28, 2012
INVENTOR(S) : Tomoyasu Takase et al.

It is certified that error appears in the above-identified patent and that said Letters Patent is hereby corrected as shown below:

Title Page, Item [86], PCT No.:

"PCT/JP2006/002936" should read --PCT/JP2006/302936--.

Signed and Sealed this
Twenty-fourth Day of April, 2012

David J. Kappos

David J. Kappos
*Director of the United States Patent and Trademark Office*